US008952805B2

(12) United States Patent
Baines et al.

(10) Patent No.: US 8,952,805 B2
(45) Date of Patent: Feb. 10, 2015

(54) WORKER'S PERSONAL ALARM DEVICE

(75) Inventors: Stephen Baines, Brisbane (AU); David McMah, Brisbane (AU)

(73) Assignee: Aurizon Operations Limited, Brisban, Queensland (AU)

( * ) Notice: Subject to any disclaimer, the term of this patent is extended or adjusted under 35 U.S.C. 154(b) by 41 days.

(21) Appl. No.: 13/820,829

(22) PCT Filed: Sep. 6, 2011

(86) PCT No.: PCT/AU2011/001150

§ 371 (c)(1), (2), (4) Date: Mar. 5, 2013

(87) PCT Pub. No.: WO2012/031322

PCT Pub. Date: Mar. 15, 2012

(65) Prior Publication Data

US 2013/0162428 A1 Jun. 27, 2013

(30) Foreign Application Priority Data

| | | |
|---|---|---|
| Sep. 6, 2010 | (AU) | 2010903992 |
| Sep. 6, 2010 | (AU) | 2010903993 |
| Oct. 12, 2010 | (AU) | 2010904562 |
| Jan. 4, 2011 | (AU) | 2011900013 |

(51) Int. Cl.

| | |
|---|---|
| ***G08B 1/08*** | (2006.01) |
| ***G08B 21/02*** | (2006.01) |
| ***B61L 23/06*** | (2006.01) |
| ***G08B 27/00*** | (2006.01) |

(52) U.S. Cl.

CPC ..... *G08B 21/02* (2013.01); *B61L 23/06* (2013.01); *G08B 27/001* (2013.01)

USPC ..... 340/539.12; 340/539.13

(58) Field of Classification Search

USPC ..... 340/539.12, 539.11, 539.13; 246/167 A

See application file for complete search history.

(56) References Cited

U.S. PATENT DOCUMENTS

| | | | | |
|---|---|---|---|---|
| 5,652,570 | A | 7/1997 | Lepkofker | |
| 6,145,792 | A | 11/2000 | Penza et al. | |
| 6,323,785 | B1 * | 11/2001 | Nickell et al. | 340/539.1 |
| 7,624,952 | B1 | 12/2009 | Bartek | |
| 8,248,263 | B2 * | 8/2012 | Shervey et al. | 340/539.13 |

(Continued)

FOREIGN PATENT DOCUMENTS

| | | |
|---|---|---|
| GB | 2409363 A | 6/2005 |
| JP | 05329109 | 12/1993 |

(Continued)

OTHER PUBLICATIONS

International-Type Search Report, Australian Patent Office, Application No. 2010904562, pp. 1-2, dated Mar. 1, 2011.

(Continued)

*Primary Examiner* — John A Tweel, Jr.

(74) *Attorney, Agent, or Firm* — Medley, Behrens & Lewis LLC; Lorri W. Cooper

(57) ABSTRACT

The present invention relates to a worker's personal alarm device for generating alarms. The alarm device includes a health monitoring means for monitoring at least one health parameter relating to a worker. The device further includes a controller for generating an alarm subsequent to determining that the health parameter is indicative of unacceptable health. The controller also generates an alarm based upon one or more conditions relating to an allocated protection zone.

20 Claims, 5 Drawing Sheets

(56) References Cited

U.S. PATENT DOCUMENTS

| | | | | |
|---|---|---|---|---|
| 8,344,877 | B2 * | 1/2013 | Sheardown et al. | 340/539.13 |
| 2003/0092971 | A1 | 5/2003 | Intrator | |
| 2006/0152373 | A1 | 7/2006 | King | |
| 2007/0177651 | A1 | 8/2007 | Daugherty et al. | |

FOREIGN PATENT DOCUMENTS

| | | | |
|---|---|---|---|
| JP | 2004097532 | | 4/2004 |
| WO | 0199077 | A2 | 12/2001 |

OTHER PUBLICATIONS

International-Type Search Report, Australian Patent Office, Application No. 2011900013, pp. 1-3, dated Mar. 1, 2011.

International Search Report, PCT/AU2011/001150, pp. 1-2, dated Nov. 10, 2011.

International Preliminary Report on Patentability, PCT/AU2011/001150, pp. 1-4, dated May 7, 2012 and Applicant's remarks/amendments, pp. 5-13, dated Apr. 5, 2012.

* cited by examiner

WORKER'S PERSONAL ALARM DEVICE

TECHNICAL FIELD

The present invention generally relates to a worker's personal alarm device. The present invention has particular, although not exclusive application to protecting railroad workers.

BACKGROUND

The reference to any prior art in this specification is not, and should not be taken as an acknowledgement or any form of suggestion that the prior art forms part of the common general knowledge.

Teams of railroad workers invariably repair and maintain railroad tracks. Each team generally includes a team leader who coordinates the activities of the team members.

In practice, the team is often required to work proximal to a railroad track during times when trains are running. The team leader in radio communication with a command centre can verbally request that the command centre divert trains to other tracks to ensure team safety. However, the applicant is aware of instances where the command centre did not correctly act upon such a request, and a train has still been diverted along a track upon which the team is working which is extremely dangerous.

In addition, the team is often dispersed over an expansive area which makes it difficult for the team leader to keep visual track of the welfare of each team member. If a team member suffers a mishap, it may undesirably take some time for the team leader or other team members to detect the mishap and then provide necessary aid.

Embodiments of the present invention provide a personal alarm device for dealing with a mishap.

SUMMARY OF THE INVENTION

According to one aspect of the present invention, there is provided an alarm method for generating alarms with a personal alarm device, the method including the steps of:

receiving at least one health parameter relating to a worker;

generating an alarm subsequent to determining that the health parameter is indicative of unacceptable health; and generating an alarm based upon a hazard being co-incident with or intersecting an allocated protection zone.

The method may further include the step of sending each alarm remotely. Each alarm may be a local alert. Each alarm may be audible or visual.

The health parameter may include any one or more of heart rate and body temperature. The health parameter may be indicative of unacceptable health it is not within acceptable limits or exceeds an acceptable threshold.

The method may further include the step of generating an alarm subsequent to determining that the worker has undergone excessive acceleration (e.g. during a fall). The method may further include the step of generating an alarm subsequent to determining that the worker is unacceptably inactive for a prolonged period of time.

The method may further include the step of sending the location of a personal alarm device. The protection zone may be allocated based upon the location of the personal alarm device. The method may further include the step of generating an alarm based upon the location of the personal alarm device relative to the protection zone in which the personal alarm device is located. The method may further include the step of generating an alarm based upon the location of the personal alarm device relative (e.g. in close proximity) to a known hazard.

The method may further include the step of generating an alarm subsequent to determining that battery power is low, or that the personal alarm device is not operating safely or correctly.

According to another aspect of the present invention, there is provided a worker's personal alarm device for generating alarms, the alarm device including:

a health monitoring means for monitoring at least one health parameter relating to a worker; and a controller for generating an alarm subsequent to determining that the health parameter is indicative of unacceptable health and for generating an alarm based upon a hazard being co-incident with or intersecting an allocated protection zone.

The health monitoring means may include a thermometer for measuring the worker's temperature. The health monitoring means may include a heart rate monitor for monitoring the worker's heart rate. The health monitoring means may include a blood pressure monitor for monitoring the worker's blood pressure.

The personal alarm device may include a distress button whereby the controller generates an alarm upon manual activation of the distress button. The device may further include an update location button to transmit an updated location of the device.

The alarm device may receive external input including a signal from a terrestrial based location system, worksite monitoring system or any other system, local or remote.

The alarm device may include a radio frequency (RF) transceiver for sending the alarm and receiving external input or alarm triggers.

The alarm device may include a speaker for generating an audible alarm. The alarm device may further include a touch screen display for generating a visual alarm. The alarm device may further include a vibrator for generating a vibrating alarm.

The alarm device may include movement means for measuring movement characteristics of the alarm device. The movement means may include an accelerometer for measuring the acceleration of the alarm device.

The alarm device may include a global positioning system (GPS) or terrestrial based location system for monitoring the location of the alarm device. The alarm device may include biometric means for sensing and/or authenticating the identity of the worker. The alarm device may include a low battery sensor.

According to another aspect of the present invention, there is provided an alarm method for generating an alarm with a personal alarm device, the method including the step of:

generating the alarm based upon a hazard being co-incident with or intersecting an allocated protection zone.

According to another aspect of the present invention, there is provided a worker's personal alarm device for generating an alarm, the alarm device configured to:

generate the alarm based upon hazard being co-incident with or intersecting allocated protection zone.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
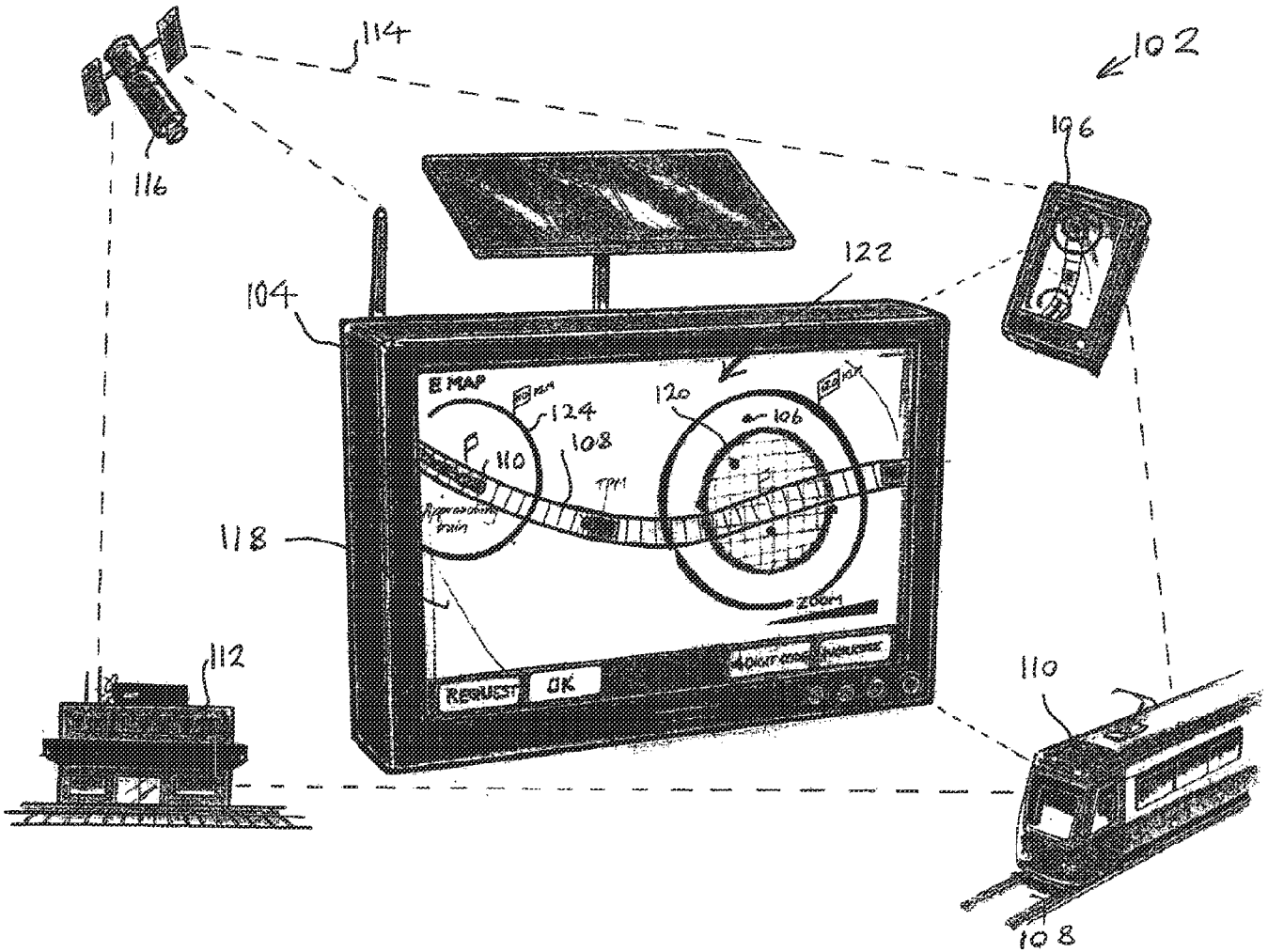
FIG. 1 is a schematic view of a railroad worker protection system in accordance with an embodiment of the present invention.

In accordance with an embodiment of the present invention, there is provided a railroad worker protection system 102 as shown in FIG. 1. The system 102 can be used to protect a team of railway workers using a portable computational device 104 carried by a leader of the team. The system 102 further includes handheld personal alarm devices 106 carried by respective other workers of the team. The team works proximal to a railway track 108 along which a train 110 can pass.

Each of the portable computational device 104, handheld personal alarm devices 106 and train 110 are in two-way communication with a computer system of a command centre 112 via a communications network 114 (generally designated by dashed lines). Furthermore, each of these system entities can communicate with each other via the network 114. The network 114 can include communication via satellite 116, dedicated radio and mobile phone infrastructure.

The portable device 104 can monitor the location of the personal alarm devices 106 carried by the team. The portable device 104 has a touch screen display user interface 118. The portable device 104 is configured to send, to the command centre 112, a protection request for allocation of a circular protection zone 120 for the team. The team can safely work within this protection zone 120. The portable device 104 is further configured to receive confirmation from the command centre 112 that the protection zone 120 has been allocated. Subsequent to allocation, the touch screen display 118 is configured to display a map 122 showing the protection zone 120 and the location of the personal alarm devices 106 carried by the workers relative to the protection zone 120.

The map 122 further shows the location of the tracks 108, train 110 and a train protection zone 124 relative to the team protection zone 120. In the event of the train protection zone 124 and the team protection zone 120 coinciding (or intersecting), the portable device 104 sends an alarm to each personal alarm device 106, the command centre 112 and the train 110. If personal alarm devices 106 carried by the workers leave the protection zone 120, the portable device 104 sends a warning alarm to each personal alarm device 106 and the computer system of the command centre 112.

Figure 2:
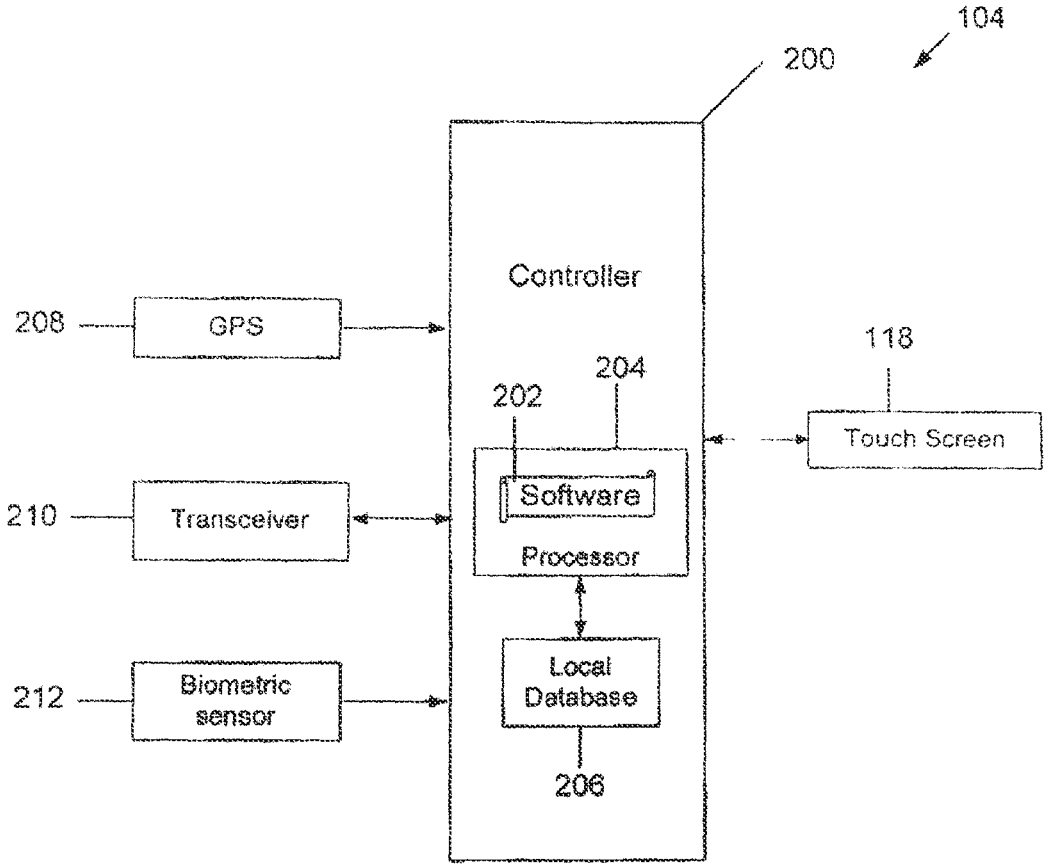
FIG. 2 is a block diagram of a portable computational device of the worker protection system of FIG. 1.

Turning to FIG. 2, the portable device 104 includes a controller 200 for controlling the operation of the device 104. The controller 200 contains a software product 202 in resident memory. In turn, the software product 202 contains computer readable instructions for execution by a processor 204 of the controller 200 to perform the railway worker protection method outlined below. The processor 204 is interfaced to a storage device (e.g. hard disc) containing a map feature database 206.

The portable device 104 further includes a Global Positioning System (GPS) 208 for determining the location of the portable device 104. The portable device 104 further includes a transceiver 210 for enabling communication with the other system entities via the network 114. The portable device 104 also includes a biometric sensor arrangement 212 for authorizing operation of the device 104 by the team leader.

The computer system of the command centre 112 is of like construction to the portable device 104 of FIG. 2.

Figure 3:
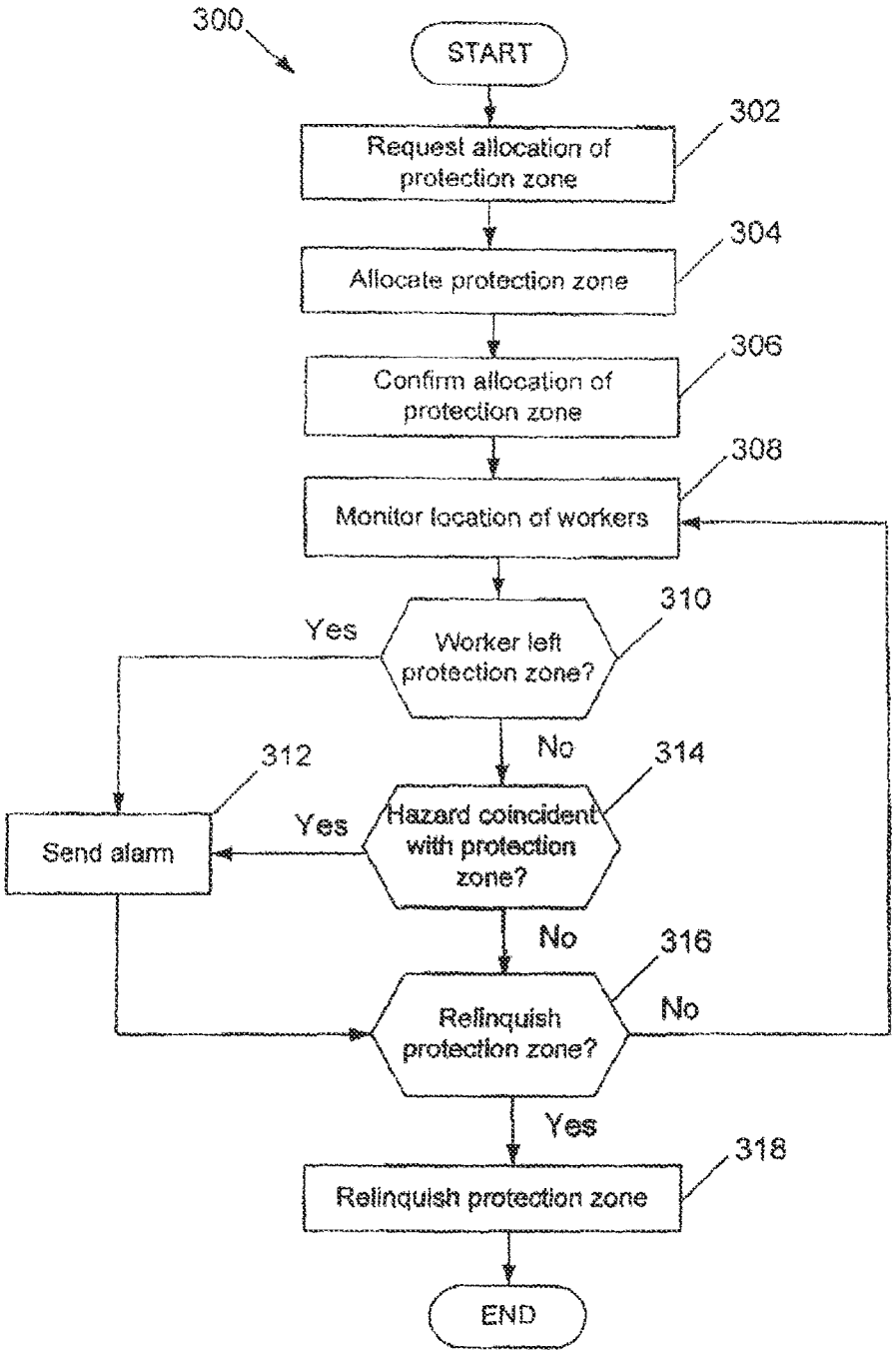
FIG. 3 is a flowchart of a railway worker protection method performed using the protection system of FIG. 1.

A railroad worker protection method 300 performed using the protection system 102 is now described with reference to FIG. 3.

Initially, the team of railway workers make their way to a worksite adjacent the railway track 108. The team leader carries the portable device 104 and the other workers carry the personal alarm device 106.

At step 302, the portable device 104 sends a protection request for allocation of the protection zone 120 for the team. In turn, the computer system of the command centre 112 receives the protection request.

At step 304, the computer system of the command centre 112 allocates the protection zone 120. The protection zone 120 is typically static and circular with the instantaneous location of the portable device 104 at its centre.

Accordingly, the protection zone 120 is located proximal the railroad track 108 or can be located near some other known static object (e.g. level crossing, location marker, signal lights, access gate, etc.).

At step 306, the computer system of the command centre 112 sends confirmation that the protection zone 120 has been allocated. In turn, the portable device 104 receives the confirmation.

At step 308, the portable device 104 monitors the location of the personal alarm devices 106 carried by the workers relative to the protection zone 102.

In this manner, the portable device 104 periodically receives the GPS location of each personal alarm device 106.

At query step 310, the portable device 104 queries whether any of personal alarm devices 106 carried by the workers have left the protection zone 120. If so, at step 312 the portable device 104 sends an appropriate warning alarm to each personal alarm device 106 and the computer system of the command centre 112. If not, the method 300 proceeds to step 314.

At query step 314, the portable device 104 queries whether a hazard is co-incident (or intersects) with the protection zone 120 (when the hazard enters the protection zone 120, or visa versa). The hazard is the train 110 or the train protection zone 124 of the train 110. If a hazard is co-incident with the protection zone 120, the method 300 proceeds to step 312 where the portable device 104 sends an appropriate warning alarm to each personal alarm device 106, the computer system of the command centre 112 and the train 110. The speed of the approaching train 110 can be automatically reduced (to zero) upon receipt of the warning alarm.

If a hazard is not co-incident with the protection zone 120, the method 300 proceeds to step 316.

At step 316, the portable device 104 queries whether input is received from the team leader indicating that the protection zone can be relinquished upon completion of work by the team. If so, the portable device 104 sends a relinquishment request to the computer system of the command centre 112. In turn at step 318, the command centre computer system receives the relinquishment request and relinquishes the protection zone 120.

If at step 316, no input is received from the team leader indicating that the protection zone can be relinquished, the method 300 returns to step 308.

Figure 4:
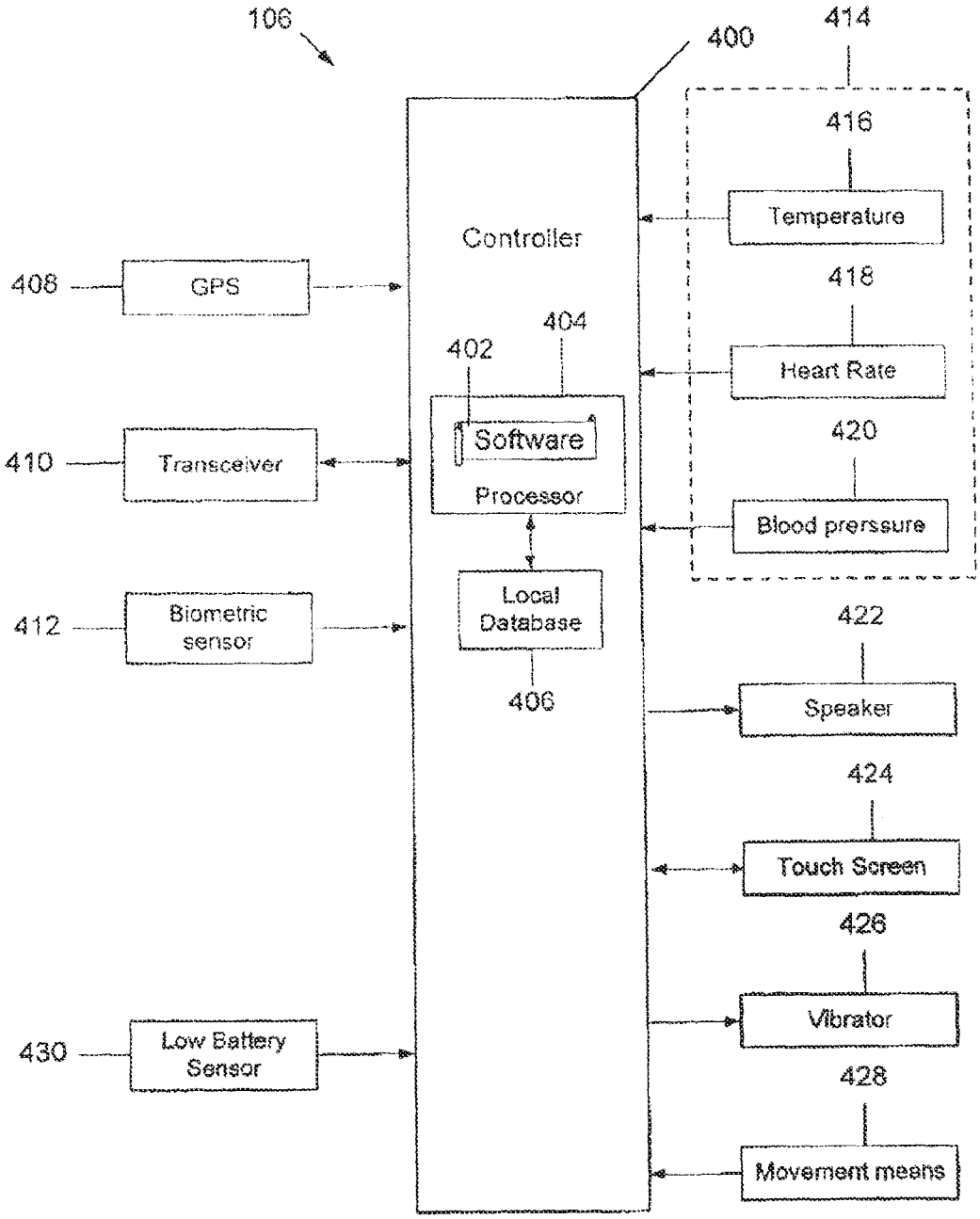
FIG. 4 is a block diagram of a worker's personal alarm device of the worker protection system of FIG. 1.

FIG. 4 shows the worker's personal alarm device 106 for generating alarms.

The personal alarm device 106 includes a controller 400 for controlling the operation of the device 106. The controller 400 contains a software product 402 in resident memory. In turn, the software product 402 contains computer readable instructions for execution by a processor 404 of the controller 400 to perform the alarm method outlined below. The processor 404 is interfaced to a storage device (e.g. hard disc) containing an acceptable worker limits database 406.

The personal alarm device 106 further includes a Global Positioning System (GPS) 408 or terrestrial based location system for determining the location of the personal alarm device 106. The personal alarm device 106 further includes a radio frequency (RF) transceiver 410 for enabling two-way communication with the other system entities via the network 114, and for sending the alarm as a message to those system entities. The personal alarm device 106 also includes a biometric sensor arrangement 412 for sensing and/or authenticating the identity of the worker.

The personal alarm device 106 further includes a health monitoring means 414 for monitoring at least one health parameter (e.g. temperature, heart rate, blood pressure) relating to the worker. The health monitoring means 414 includes a thermometer 416 for measuring the worker's temperature, a heart rate monitor 418 for monitoring the worker's heart rate and a blood pressure monitor 420 for monitoring the worker's blood pressure.

The controller 400 is configured to generate the alarm subsequent to determining that one of the monitored health parameters is indicative of unacceptable health when compared with acceptable limits stored in the limits database 406. The personal alarm device 106 further includes a speaker 422 for generating an audible alarm, a touch screen display 424 for generating a visual alarm, and a vibrator 426 for generating a vibrating alarm. As previously discussed, an alarm in the form of a message can also be transmitted by the transceiver 410.

The personal alarm device 106 also includes movement means 428 for measuring movement characteristics of the alarm device 106. The movement means includes an accelerometer for measuring the acceleration of the alarm device 106. The alarm device 106 also includes a battery and a low battery sensor 430.

Figure 5:
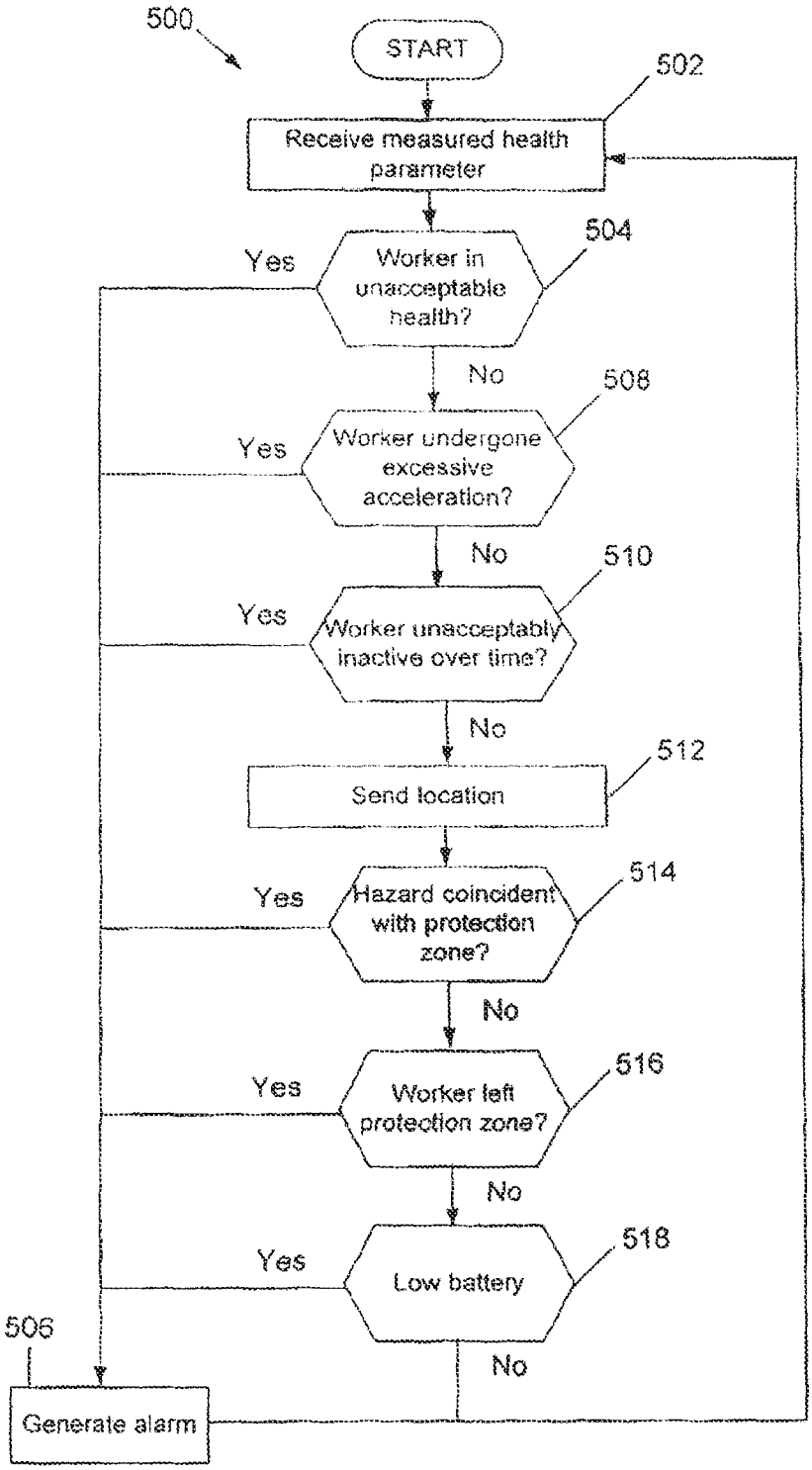
FIG. 5 is a flowchart of an alarm method performed using the alarm device of FIG. 4.

An alarm method 500 performed using the personal alarm device 106 is now described with reference to FIG. 5.

Initially, the personal alarm device 106 establishes connection and communication with the portable device 104. The portable device 104 is configured to periodically verify with a heartbeat signal that it is in communication with each personal alarm device 106 when the protection zone 120 is allocated. In the event that the personal alarm device 106 loses communication with the portable device 104, the personal alarm device 106 generates a visual, audible, vibration and/or transmitted message alarm.

At step 502, the controller 400 receives at least one measured health parameter (temperature, heart rate, blood pressure) relating to the worker from the health monitoring means 414.

At query step 504, the controller 400 queries whether the health parameter is indicative of unacceptable health by comparing the parameter with acceptable health limits stored in the acceptable worker limits database 406. If so, at step 506 the personal alarm device 106 generates an appropriate alarm. If not, the method 500 proceeds to step 508. The health parameter is indicative of unacceptable health if it is not within acceptable limits or exceeds an acceptable threshold.

At step 506, the alarm includes any one or more of an audible alarm generated by the speaker 422, a visual alarm generated by the touch screen display 424, a vibrating alarm generated by a vibrator 426, or a message alarm sent by the transceiver 410 to the portable device 104 or computer system of the command centre 112.

At query step 508, the controller 400 queries whether the personal alarm device 106 carried by the worker has undergone excessive acceleration (e.g. during a fall or when being hit by a vehicle) using movement measurements from the movement means 428. The movement measurements are compared with acceptable limits stored in the limits database 406. If the personal alarm device 106 has undergone excessive acceleration, at step 506 the personal alarm device 106 generates an appropriate alarm. If not, the method 500 proceeds to step 510.

At query step 510, the controller 400 queries whether the personal alarm device 106 carried by the worker is unacceptably inactive for a prolonged period of time (e.g. fainting) using the movement means 428. If so, at step 506 the personal alarm device 106 generates an appropriate alarm. If not, the method 500 proceeds to step 512.

At step 512, the controller 400 sends via transceiver 410 the location of the personal alarm device 106 using location information received from the GPS 408. In turn, the portable device 104 and computer system of the command centre 112 receive the location. The device 106 may include a manually activated update location button to transmit an updated location of the device 106.

At query step 514, the controller 400 queries whether a hazard is co-incident with (or intersects) the protection zone 120 in which the personal alarm device 106 is located. If so, and the personal alarm device 106 receives an appropriate warning alarm from the portable device 104 sent at step 312 and responsive to step 314, at step 506 the personal alarm device 106 generates an appropriate alarm. If not, the method 500 proceeds to step 516.

At query step 516, the controller 400 queries whether the personal alarm device 106 has left the protection zone 102 in which the personal alarm device 106 is located. If so, and the personal alarm device 106 receives an appropriate warning alarm from the portable device 104 sent at step 312 and responsive to step 310, at step 506 the personal alarm device 106 generates an appropriate alarm. If not, the method 500 proceeds to step 518.

At query step 518, the controller 400 queries whether the battery power is low based upon input from the low battery sensor 430. If so, at step 506 the personal alarm device 106 generates an appropriate alarm. If not, the method 500 returns to step 502.

The alarm method 500 can end when the worker turns off the personal alarm device 106 once the work is completed and alarm monitoring is no longer required.

A person skilled in the art will appreciate that many embodiments and variations can be made without departing from the ambit of the present invention.

The portable device 104 of the preferred embodiment was configured to send a warning alarm of high severity to each worker's handheld device or the command centre 112 upon detecting that one of the workers has left the protection zone 120. In another embodiment, the portable device 104 is configured send a warning alarm of lesser severity upon detecting that one of the workers is about to leave (or is in close proximity to the edge of) the protection zone 120 and is in a cautionary severity area.

At step 314 above, the portable device 104 queries whether a hazard in the form of a train 110 or train protection zone 124 is co-incident (or intersects) with the worker protection zone

120. In another embodiment, the hazard may instead include a railroad maintenance truck or associated truck protection zone.

In the preferred embodiment, the worker protection zone 120 was static around the work site. In an alternative embodiment, the worker protection zone 120 may be dynamic (i.e. able to vary in location) and have the portable device 104 at its centre.

In one embodiment, the personal alarm device 106 is configured to send the health information to the portable device 104. The portable device 104 is then configured to receive the health information and can generate a health alarm responsive to determining that the health information is indicative of unacceptable health. The portable device 104 is then configured to send the health alarm to each personal alarm device 106 and the command centre computer system.

In one embodiment, the personal alarm device 106 is configured to generate an alarm based upon the location of the personal alarm device relative (e.g. in close proximity) to a known hazard such as a mineshaft or pit marked with a RF transmitter.

The personal alarm device 106 may be configured to generate an alarm subsequent to determining that the personal alarm device is not operating safely or correctly.

The personal alarm device 106 may include a distress button whereby the so that it generates an alarm upon manual activation of the distress button.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

The claims defining the invention are as follows:

1. An alarm method for generating alarms with a personal alarm device, the method including the steps of:

receiving at least one health parameter relating to a worker;

generating an alarm subsequent to determining that the health parameter is indicative of unacceptable health; and generating an alarm based upon a hazard being co-incident with or intersecting an allocated protection zone.

2. An alarm method as claimed in claim 1, wherein the protection zone is allocated based upon the location of the personal alarm device.

3. An alarm method as claimed in claim 1, further including the step of generating an alarm based upon the location of the personal alarm device relative to the protection zone.

4. An alarm method as claimed in claim 1, further including the step of generating an alarm based upon the location of the personal alarm device relative to a hazard.

5. An alarm method as claimed in claim 1, wherein the health parameter includes any one or more of heart rate and body temperature.

6. An alarm method as claimed in claim 1, further including the step of generating an alarm subsequent to either determining that the worker has undergone excessive acceleration or determining that the worker is unacceptably inactive for a prolonged period of time.

7. A worker's personal alarm device for generating alarms, the alarm device including:

a health monitoring means for monitoring at least one health parameter relating to a worker; and a controller for generating an alarm subsequent to determining that the health parameter is indicative of unacceptable health and for generating an alarm based upon a hazard being co-incident with or intersecting an allocated protection zone.

8. A worker's personal alarm device as claimed in claim 7, wherein the health monitoring means includes one or more of a thermometer for measuring the worker's temperature, a heart rate monitor for monitoring the worker's heart rate, a blood pressure monitor for monitoring the worker's blood pressure and a distress button whereby the controller generates an alarm upon manual activation of the distress button.

9. A worker's personal alarm device as claimed in claim 7, including movement means for measuring movement characteristics of the alarm device.

10. An alarm method for generating an alarm with a personal alarm device, the method including the step of:

generating the alarm based upon a hazard being co-incident with or intersecting an allocated protection zone.

11. An alarm method as claimed in claim 10, wherein the protection zone is allocated based upon the location of the personal alarm device.

12. An alarm method as claimed in claim 10, further including the step of generating an alarm based on the location of the personal alarm device relative to the protection zone.

13. An alarm method as claimed in claim 10, further including the step of generating an alarm based upon the location of the personal alarm device relative to a hazard.

14. An alarm method as claimed in claim 10, further including the step of generating an alarm subsequent to determining that worker is of unacceptable health.

15. An alarm method as claimed in claim 10, further including the step of generating an alarm subsequent to either determining that the worker has undergone excessive acceleration or determining that the worker is unacceptably inactive for a prolonged period of time.

16. A worker's personal alarm device for generating an alarm, the alarm device configured to:

generate the alarm based upon a hazard being co-incident with or intersecting an allocated protection zone.

17. A worker's personal alarm device as claimed in claim 16, wherein the protection zone is allocated based upon the location of the personal alarm device.

18. A worker's personal alarm device as claimed in claim 16, further including the step of generating an alarm based upon the location of the personal alarm device relative to the protection zone.

19. A worker's personal alarm device as claimed in claim 16, further configured to generate an alarm based upon the location of the personal alarm device relative to a hazard.

20. A worker's personal alarm device as claimed in claim 16, further configured to generate an alarm subsequent to:

determining that worker is of unacceptable health;

determining that the worker has undergone excessive acceleration; or determining that the worker is unacceptably inactive for a prolonged period of time.

* * * * *